US011583706B2

(12) United States Patent
McCoy et al.

(10) Patent No.: US 11,583,706 B2
(45) Date of Patent: Feb. 21, 2023

(54) HEADGEAR

(71) Applicant: Kimberly-Clark Worldwide, Inc., Neenah, WI (US)

(72) Inventors: Theresa M. McCoy, Cumming, GA (US); Alice S. Gordon, Roswell, GA (US); Suzuko Hisata, Atlanta, GA (US); JaeHun Gu, Doraville, GA (US); Alyssa G. Mellett, Kennesaw, GA (US); Philip D. Palermo, Marietta, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 680 days.

(21) Appl. No.: 16/499,518

(22) PCT Filed: Mar. 30, 2018

(86) PCT No.: PCT/US2018/025435

§ 371 (c)(1),
(2) Date: Sep. 30, 2019

(87) PCT Pub. No.: WO2018/183872

PCT Pub. Date: Oct. 4, 2018

(65) Prior Publication Data

US 2021/0128953 A1 May 6, 2021

Related U.S. Application Data

(60) Provisional application No. 62/480,011, filed on Mar. 31, 2017.

(51) Int. Cl.
*A62B 7/10* (2006.01)
*A41D 13/11* (2006.01)
(Continued)

(52) U.S. Cl.
CPC ..... *A62B 7/10* (2013.01); *A41D 13/1153* (2013.01); *A41D 13/1184* (2013.01); *A42B 3/24* (2013.01); *A62B 18/04* (2013.01); *A62B 23/02* (2013.01)

(58) Field of Classification Search
CPC ..... A62B 7/00; A62B 7/10; A62B 17/00–001; A62B 17/006; A62B 17/04; A62B 18/00;
(Continued)

(56) References Cited

U.S. PATENT DOCUMENTS 4,296,746 A * 10/1981 Mason, Jr ..... A62B 18/02 128/201.15
4,419,993 A * 12/1983 Petersen ..... A41D 13/1123 128/201.15
(Continued)

FOREIGN PATENT DOCUMENTS

CN 2440464 Y 8/2001
CN 2536065 Y * 2/2003
(Continued)

*Primary Examiner* — Rachel T Sippel

(57) ABSTRACT

A headgear device for a user including an integrated face shield, mask and hood. More specifically, the headgear device includes a hood, a face shield, and a moisture barrier fabric to cover the user's mouth when the headgear device is worn and direct air out through a breathable particle filtration fabric.

13 Claims, 3 Drawing Sheets

(51) Int. Cl.

| | |
|---|---|
| ***A42B 3/24*** | (2006.01) |
| ***A62B 18/04*** | (2006.01) |
| ***A62B 23/02*** | (2006.01) |

(58) Field of Classification Search

CPC ..... A62B 18/02–025; A62B 18/04; A62B 18/08–084; A62B 23/00–025; A41D 13/11–1192; A42B 3/24; A42B 3/28; A42B 3/225; A42B 3/288

See application file for complete search history.

(56) References Cited

U.S. PATENT DOCUMENTS

| | | | | |
|---|---|---|---|---|
| 2013/0014316 | A1* | 1/2013 | Castro ..... | G02C 11/00 2/427 |
| 2013/0117912 | A1 | 5/2013 | Duncan | |
| 2015/0057621 | A1 | 2/2015 | Coombs | |
| 2016/0165973 | A1 | 6/2016 | Yazdi et al. | |
| 2016/0243383 | A1 | 8/2016 | Yazdi et al. | |

FOREIGN PATENT DOCUMENTS

| | | | |
|---|---|---|---|
| CN | 1997427 | A | 7/2007 |
| CN | 202982977 | U | 6/2013 |
| EP | 1862199 | B1 | 9/2012 |
| JP | 10155924 | A | 6/1998 |
| KR | 200415425 | Y1 | 5/2006 |
| KR | 20140144538 | A | 12/2014 |

* cited by examiner

HEADGEAR

This application claims priority from U.S. provisional Patent Application Ser. No. 62/480,011 filed on Mar. 31, 2017, the entire contents of which are incorporated herein by reference.

TECHNICAL FIELD

This disclosure relates to protective apparel.

BACKGROUND OF THE DISCLOSURE

In many scenarios there is a need to protect workers from the environmental conditions in which they work and/or protect the work piece or work process, e.g., manufacturing process, from contamination from the worker. For example, in some industrial or manufacturing settings, there could be harmful particulate in the air and/or flying debris. To address these issues, workers often don masks, eyewear and/or a hood. Although needed to prevent injury or reduce contamination, donning and use of this protective apparel can be a time consuming and/or unpleasant experience. For example, it can be difficult to don a separate mask, hood and eyewear to ensure all are placed to provide the designed protection and yet fit comfortably.

SUMMARY OF THE DISCLOSURE

In general, one aspect of the subject matter described in this specification can be implemented in a headgear device for a user comprising a transparent face shield including a top portion, side portion and bottom portion; a moisture barrier fabric including a upper edge and a lower edge, wherein the lower edge is proximate the (i) side portion, including at a first position, and (ii) the bottom portion of the face shield, and wherein the upper edge is configured to lay across the user's nose, and the moisture barrier fabric is configured to cover the user's mouth when the headgear device is worn; a particle filtration fabric including an top perimeter and a bottom perimeter, wherein the top perimeter is proximate (i) the side portion, including at a second position, and (ii) the bottom portion of the face shield, and wherein the second position is closer to the top portion of the face shield than the first position and the particle filtration fabric is breathable; and a hood proximate the top portion of the face shield and the bottom perimeter of the particle filtration fabric. Other embodiments of this aspect include corresponding systems and methods.

Particular embodiments of the subject matter described in this specification can be implemented so as to realize one or more of the following advantages. The headgear device combines a mask, hood and face shield (or goggles) in a single integrated unit that avoids the fitment issues associated with donning and positioning separate apparel to try and ensure each piece is individually placed to function correctly in a manner that is also comfortable for the wearer. The upper mask portion, covering the wearer's nose and mouth, is made from a moisture barrier fabric that directs exhaled away from the face shield, to reduce fogging, toward the breathable lower mask portion that allows the exhaled air to escape and allows fresh air in, to increase wearer comfort.

The details of one or more implementations of the subject matter described in this specification are set forth in the accompanying drawings and the description below. Other features, aspects, and advantages of the subject matter will become apparent from the description, the drawings, and the claims.

Figure 1:
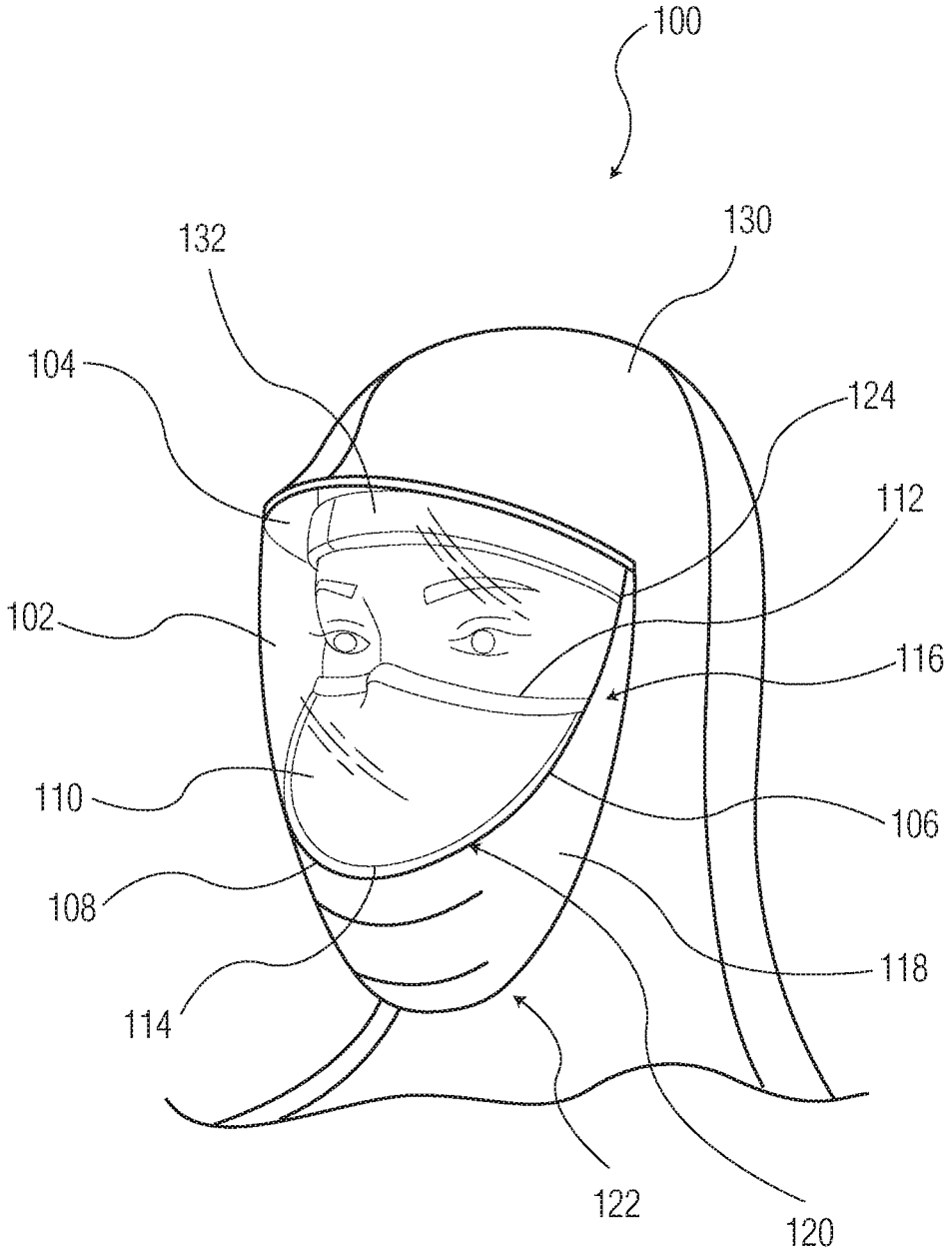
FIG. 1 is a front perspective view of a headgear device.

Repeat use of reference characters in the present specification and drawings is intended to represent the same or analogous features or elements of the disclosure.

DETAILED DESCRIPTION OF THE DISCLOSURE

Many environments, e.g., industrial and scientific manufacturing facilities, require the use of protective apparel including hoods, masks and face shields (or goggles or other eye protection devices). The headgear device described in this specification combines all three of these components into one integrated unit. More specifically, the headgear unit includes a hood and face shield with a moisture barrier covering positioned over the wearer's nose and mouth to divert exhaled air away from the face shield and out through a breathable mask portion to prevent face shield fogging and user discomfort, e.g., from the humid and warm exhaled air that would otherwise be directed back into the hood. The headgear device is described in more detail below with respect to FIGS. 1-3.

The headgear device 100 includes a transparent face shield 102. In some implementations the face shield 102 is clear while in others it is tinted, e.g., for environments with bright lights or for user preference. The face shield 102 can be made from, for example, a gamma irradiation stable visor material (e.g., a copolyester-based material), a transparent or translucent material and/or a thermoformable material. The face shield 102 includes a top portion 104, side portion 106 and bottom portion 108. The side portions 106 describe the portion of the face shield 102 between the top portion 104 and bottom portion 108—the bottom portion 108 being distal from the top portion 104. In some implementations, the face shield 102 extends, when donned, from above the wearer's eyes to below the wearer's nose and, in some cases, below the wearer's chin.

The headgear device 100 also includes a moisture barrier fabric 110. The moisture barrier fabric 110 functions to cover the wearer's mouth (and nose) when the headgear device 100 is worn and is positioned to deflect exhaled air, for example, from the wearer's mouth and/or nose away from the face shield 102 and, more generally, away from the interior of the headgear device 100. In some implementations, the moisture barrier fabric is made of nonwoven materials that may or may not have stretch, for example, stretchable film laminates or stretchable nonwovens. In some implementations, woven materials can alternatively be used. The moisture barrier fabric serves as a barrier to moisture vapor to prevent or reduce exhaled air, or components thereof, from passing through it, as compared with the particle filtration fabric as described below.

Figure 2:
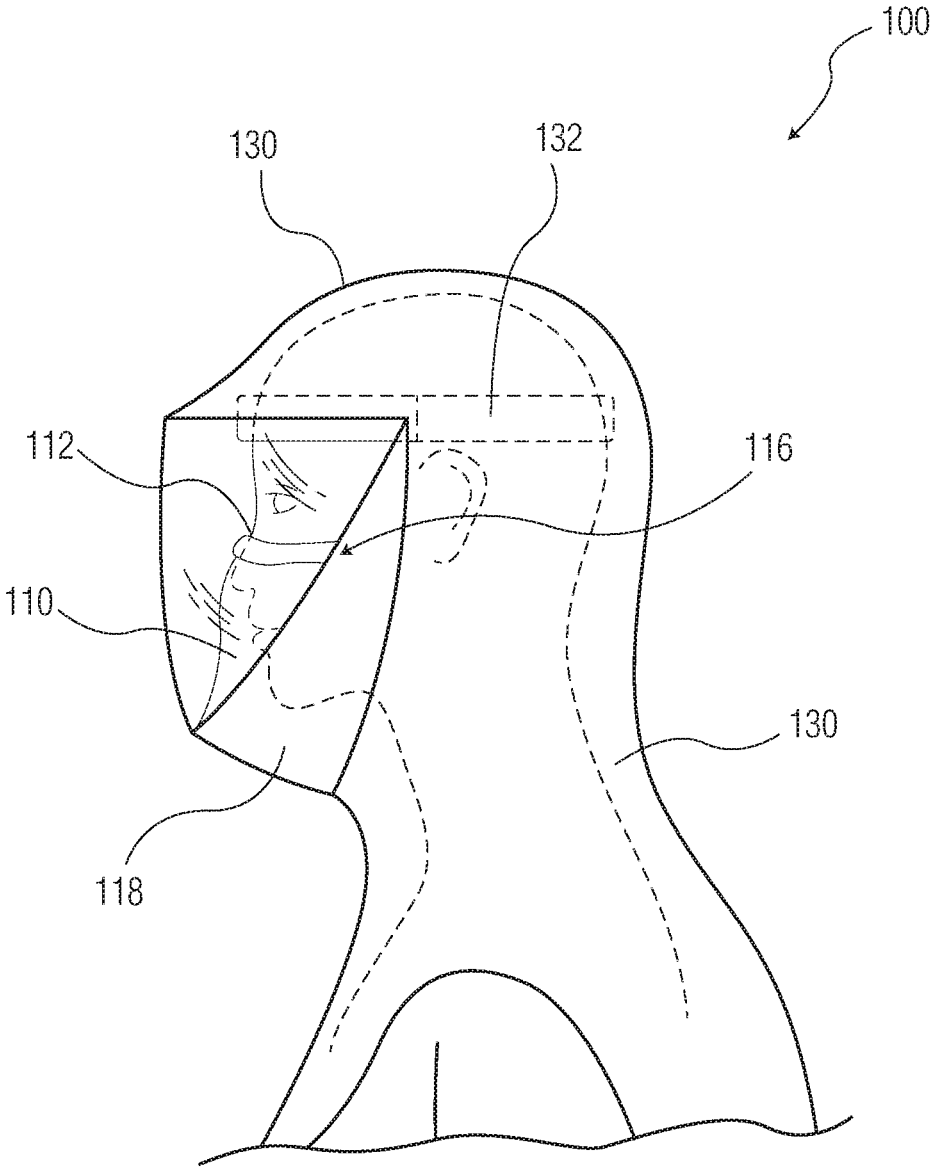
FIG. 2 is a side cutaway view thereof.

The moisture barrier fabric 110 includes an upper edge 112 and a lower edge 114. The lower edge 114 is proximate the (i) side portion 106, including at a first position 116 on the side portion 116, and (ii) the bottom portion 108. In some implementations the upper and lower edges 112, 114 of the moisture barrier fabric 110 are directly connected to the face shield 102 at or near the perimeter edges of the side and bottom portions 106, 108, as shown in FIG. 1.

The moisture barrier fabric 110 can be attached to the face shield 102 in numerous ways. For example, the moisture barrier fabric 110 can be sewn to the face shield 102 (or through another mechanical attachment process) or attached through ultrasonic welding, adhesives or the like. In some implementations, the upper and lower edges 112, 114 are indirectly connected to the face shield 102 through an intervening material suited to couple the face shield 102 to the moisture barrier fabric 110. For example, such intervening material can be another material capable of preventing or reducing the exhaled air from passing through it towards the face shield 102. Further, in some implementations, the face shield 102 can extend to at least to a point proximate the wearer's chin and, in some implementations, down below the attachment point(s) to the moisture barrier fabric 110 such that the face shield 102 overhangs the lower edge 114.

As described above, the moisture barrier fabric 110 directs air flow away from the face shield 102. Likewise to prevent or reduce the flow of exhaled air from migrating up between the wearer's face and the moisture barrier fabric 110 the upper edge 112 of the moisture barrier fabric 110 is designed to lay across the wearer's nose and face. Thus, the upper edge 112 is designed to reduce or minimize any gaps at the interface between it and the wearer's face.

The headgear device 100 includes a hood 130. The hood 130, when the headgear device 100 is donned, covers the wearer's head and, in some implementations, drapes down over the wearer's should, back and/or chest. The hood 130, for example, is made from breathable nonwoven materials (e.g., stretch), breathable film laminates, nonbreathable film laminates, or temperature regulating (e.g., cooling) materials. Generally, the hood 130 functions to reduce contaminates from reaching the wearer's head and reduce contamination from the wearer, e.g., skin cells, from migrating to the wearer's environment. The hood 130 can, for example, include a frame 132 to elevate the hood 130 above the wearer's head when the headgear device 100 is worn. The frame 132 can be a plastic or other composite material and include pads or cushions where the frame 132 rests on the wearer's head to promote wearer comfort. The frame 132 can attach, for example, to the top portion of the hood through a mechanical fastener or an adhesive.

As described above, the headgear device 100 includes a particle filtration fabric 118. The particle filtration fabric 118 is made of a breathable material, e.g., a material that allows and is designed to allow at least some moisture vapor to pass. Comparatively the particle filtration fabric 118 is more breathable than the moisture barrier fabric 110—the particle filtration fabric 118 allows, on a relative basis, more moisture vapor to pass than the moisture barrier fabric 110. In some implementations, the moisture barrier fabric 110 has an air permeability level lower, e.g., less likely to pass air, than that of the particle filtration fabric 118. The particle filtration fabric 118 functions as a mask to reduce the wearer's exposure to particulate while facilitating the wearer's respiration and/or to prevent/inhibit particulation from the wearer through the device 100 to the environment as in cleanroom applications. In some implementations, the particle filtration fabric 118 is made of a nonwoven material such as SB/MB layers or laminates, but other materials that function as provided above are envisioned.

The particle filtration fabric 118 has a top perimeter 120 and a bottom perimeter 122. The top perimeter 120 is proximate (i) the side portion 106, including proximate a second position 124, and (ii) the bottom portion 108 of the face shield 102. The second position 124 is closer to the top portion 104 than the first position 116. The second position 124 can be, for example, above the user's eyes to allow warm and/or humid air around the wearer's face to naturally flow up and out through this region of the particle filtration fabric 118. In some implementations, the top perimeter 120 extends up to the top portion 104.

In some implementations the top perimeter 120 and a bottom perimeter 122 are directly connected (or proximately connected) to the face shield 102 and hood 130, respectively, at or near the perimeter edges, as shown in FIG. 1. The particle filtration fabric 118 can be, for example, sewn to the face shield 102 and hood (or through another mechanical attachment process) or attached through ultrasonic welding, adhesives or the like. In some implementations, the top and bottom perimeters 120, 122 are indirectly connected to the face shield 102 and hood 130 through an intervening material(s) suited to couple the face shield 102 to the particle filtration fabric 118 and the hood 130 to the particle filtration fabric 118. In some implementations, the particle filtration fabric 118 and the moisture barrier fabric 110 are connected to the face shield 102 at or near the same interface.

Figure 3:
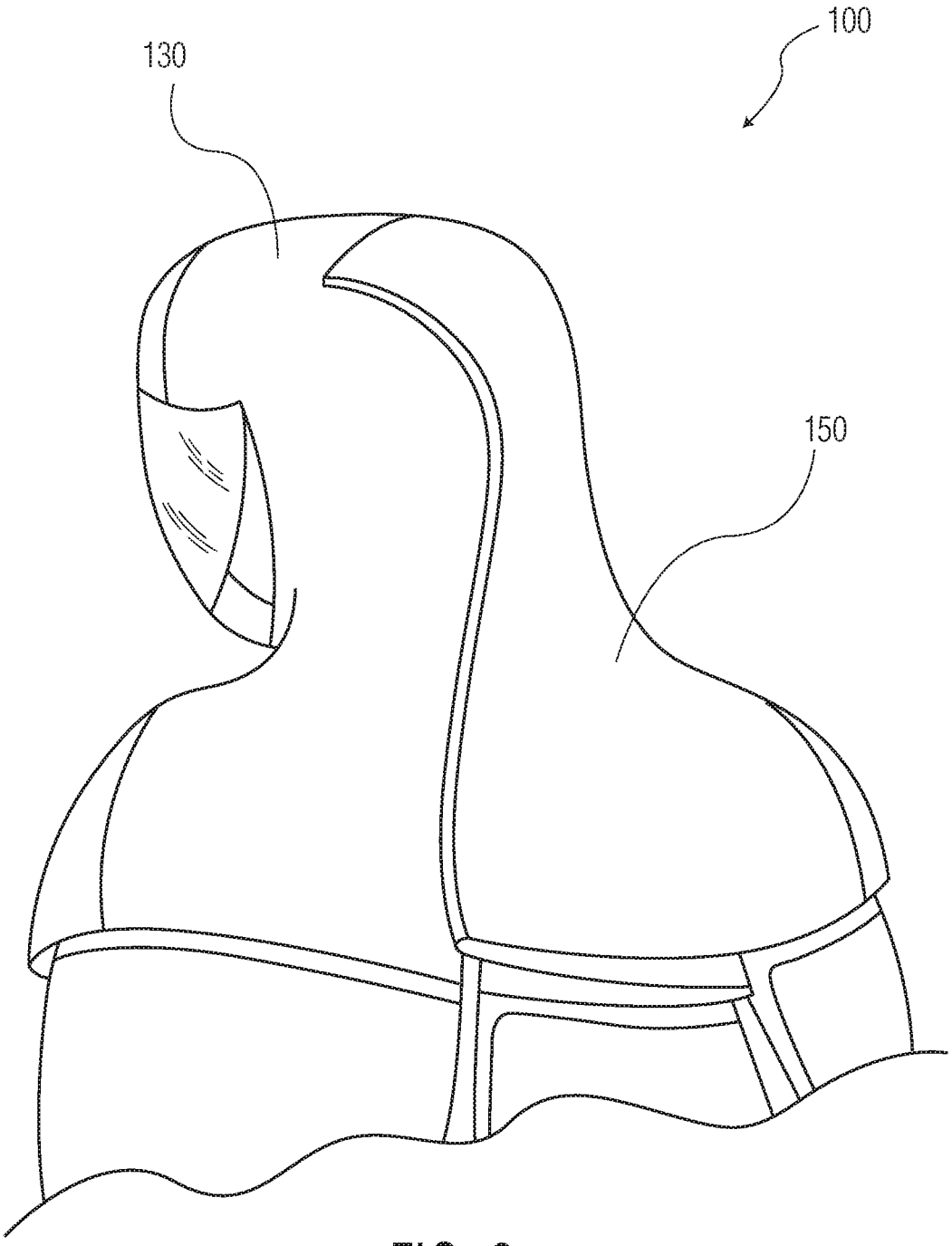
FIG. 3 is a back perspective view thereof.

In some implementations, the headgear device 100 includes a pleat 150, as shown in FIG. 3, to enhance wearer comfort.

In some implementations, the headgear device 100 is intended to be disposable, e.g., used for a limited time and then replaced.

Embodiments

Embodiment 1. A headgear device for a user comprising:

a transparent face shield including a top portion, side portion and bottom portion;

a moisture barrier fabric including a upper edge and a lower edge, wherein the lower edge is proximate the (i) side portion, including at a first position, and (ii) the bottom portion of the face shield, and wherein the upper edge is configured to lay across the user's nose, and the moisture barrier fabric is configured to cover the user's mouth when the headgear device is worn;

a particle filtration fabric including an top perimeter and a bottom perimeter, wherein the top perimeter is proximate (i) the side portion, including at a second position, and (ii) the bottom portion of the face shield, and wherein the second position is closer to the top portion of the face shield than the first position and the particle filtration fabric is breathable; and a hood proximate the top portion of the face shield and the bottom perimeter of the particle filtration fabric.

Embodiment 2. The headgear device of embodiment 1, wherein the moisture barrier fabric is less breathable than the particle filtration fabric.

Embodiment 3. The headgear device of embodiment 1 or 2, wherein the moisture barrier fabric has an air permeability level lower than that of the particle filtration fabric.

Embodiment 4. The headgear device of any preceding embodiment, wherein the second position is above the user's eyes.

Embodiment 5. The headgear device of any preceding embodiment comprising a frame coupled to the hood and configured to elevate the hood above the user's head when the headgear device is worn.

Embodiment 6. The headgear device of any preceding embodiment wherein the particle filtration fabric is coupled to the face shield through a sewn seam.

Embodiment 7. The headgear device of any preceding embodiment wherein the moisture barrier fabric is coupled to the face shield through a sewn seam.

Embodiment 8. The headgear device of any preceding embodiment, wherein, when the headgear is worn, the top portion of the face shield is above the user's eyes and the bottom portion extends at least to a point proximate the user's chin.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A headgear device for a user comprising:

a transparent face shield including a top portion, side portion and bottom portion;

a moisture barrier fabric including a upper edge and a lower edge, wherein the lower edge is proximate the (i) side portion, including at a first position, and (ii) the bottom portion of the face shield, and wherein the upper edge is configured to lay across the user's nose, and the moisture barrier fabric is configured to cover the user's mouth when the headgear device is worn;

a particle filtration fabric including a top perimeter and a bottom perimeter, wherein the top perimeter is adapted to be proximate (i) the side portion, including at a second position, and (ii) the bottom portion of the face shield, and wherein the second position is above the user's eyes and the particle filtration fabric is breathable and wherein the particle filtration fabric is made from a first material; and a hood proximate the top portion of the face shield and the bottom perimeter of the particle filtration fabric, and is configured to cover the user's entire head when the user wears the headgear device, wherein the hood is made from a second material different from the first material.

2. The headgear device of claim 1, wherein the moisture barrier fabric is less breathable than the particle filtration fabric.

3. The headgear device of claim 1, wherein the moisture barrier fabric has an air permeability level lower than that of the particle filtration fabric.

4. The headgear device of claim 1, wherein the hood comprises a frame configured to elevate the hood above the user's head when the headgear device is worn.

5. The headgear device of claim 1 wherein the particle filtration fabric is coupled to the face shield through a sewn seam.

6. The headgear device of claim 1 wherein the moisture barrier fabric is coupled to the face shield through a sewn seam.

7. The headgear device of claim 1, wherein, when the headgear device is worn, the top portion of the face shield is above the user's eyes and the bottom portion extends at least to a point proximate the user's chin.

8. The headgear device of claim 1, wherein the particle filtration fabric when worn is continuous from below the user's mouth to above the user's eyes.

9. The headgear device of claim 1, wherein the hood drapes down over the user's back when worn.

10. A headgear device for a user comprising:

a transparent face shield including a top portion, side portion and bottom portion;

a moisture barrier fabric including a upper edge and a lower edge, wherein the lower edge is connected to the (i) side portion, including at a first position, and (ii) the bottom portion of the face shield, and wherein the upper edge is configured to lay across the user's nose and cheeks, and the moisture barrier fabric is configured to cover the user's nose and mouth when the headgear device is worn;

a particle filtration fabric including a top perimeter and a bottom perimeter, wherein the top perimeter is connected to (i) the side portion, including at a second position, and (ii) the bottom portion of the face shield, and wherein the second position is adapted to be above the user's eyes and the particle filtration fabric is breathable and wherein the particle filtration fabric is made from a first material; and a hood proximate the top portion of the face shield and the bottom perimeter of the particle filtration fabric; wherein the hood includes a frame to provide an air gap between the user's head and the headgear device and is configured to cover the user's entire head when the user wears the headgear device, and wherein the hood is made from a second material different from the first material.

11. The headgear device of claim 10, wherein the moisture barrier fabric is less breathable than the particle filtration fabric.

12. The headgear device of claim 10, wherein the moisture barrier fabric has an air permeability level lower than that of the particle filtration fabric.

13. The headgear device of claim 10, wherein the particle filtration fabric when worn is continuous from below the user's mouth to above the user's eyes.

* * * * *